US012797760B2

(12) United States Patent
Yancey et al.

(10) Patent No.: US 12,797,760 B2
(45) Date of Patent: Nov. 17, 2026

(54) ELASTOMERIC COUPLING METHODS AND DEVICES

(71) Applicant: DISNEY ENTERPRISES, INC., Burbank, CA (US)

(72) Inventors: Kathryn Joan Yancey, San Clemente, CA (US); Brooke Dozier, Orlando, FL (US); Michael Kutcher, Toluca Lake, CA (US); Kenneth Chapman, Jr., South Pasadena, CA (US); Reona Toney, Northridge, CA (US); David Powell Goldberg, Altadena, CA (US); Whitney J. Babin, Windermere, FL (US); Christopher John Mazzella, Altadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 184 days.

(21) Appl. No.: 18/773,860

(22) Filed: Jul. 16, 2024

(65) Prior Publication Data

US 2026/0021420 A1 Jan. 22, 2026

(51) Int. Cl.
*A63H 3/48* (2006.01)
*A63J 19/00* (2006.01)

(52) U.S. Cl.
CPC ..... *A63H 3/48* (2013.01); *A63J 19/006* (2013.01)

(58) Field of Classification Search
CPC .. A63H 3/36; A63H 3/365; A63H 3/48; A63J 19/006; B25J 9/0012; B25J 11/0015
USPC ..... 446/268, 321, 337, 385, 391; 264/242, 264/277; 434/267, 270
See application file for complete search history.

(56) References Cited

U.S. PATENT DOCUMENTS 3,180,054 A * 4/1965 Knott ..... A63H 3/48 446/337
3,406,482 A * 10/1968 Ryan ..... A63H 13/005 446/337
3,691,676 A * 9/1972 Mellow ..... A63H 7/00 446/337
3,745,696 A * 7/1973 Sapkus ..... A63H 3/48 446/338
3,828,469 A * 8/1974 Giroud ..... A63H 13/005 446/337
3,841,020 A * 10/1974 Ryan ..... A63H 3/24 446/190
5,584,741 A * 12/1996 Cheung ..... A63H 3/48 446/337
6,544,094 B1 * 4/2003 Maddocks ..... A63H 3/365 446/337
6,733,359 B1 * 5/2004 Jacobs ..... A63H 13/005 446/391
7,113,848 B2 * 9/2006 Hanson ..... G16Z 99/00 700/258
7,718,105 B2 * 5/2010 Tye ..... B33Y 80/00 264/277

(Continued)

*Primary Examiner* — Alexander R Niconovich
(74) *Attorney, Agent, or Firm* — Dorsey & Whitney LLP

(57) ABSTRACT

An animated device includes a skin. The skin includes a membrane formed of a first elastomeric material and a coupling feature coupled to the membrane. The coupling feature includes an elongated portion, and a second elastomeric material. The animated device includes a shell comprising a complementary elongated portion configured to couple to the elongated portion.

20 Claims, 7 Drawing Sheets

(56) References Cited

U.S. PATENT DOCUMENTS

| | | | | |
|---|---|---|---|---|
| 7,740,953 | B2 * | 6/2010 | Jackson | B29C 39/025 446/337 |
| 7,819,719 | B2 * | 10/2010 | Tye | B62D 57/032 446/268 |
| 7,887,729 | B2 | 2/2011 | Tye et al. | |
| 8,568,642 | B2 * | 10/2013 | Jackson | B29C 39/10 901/50 |
| RE45,464 | E * | 4/2015 | Kornbluh | A63H 13/005 310/326 |
| 9,403,099 | B2 * | 8/2016 | Tye | B29C 39/025 |
| 9,592,455 | B2 * | 3/2017 | Tiefel | A63H 3/20 |
| 10,137,602 | B2 * | 11/2018 | Jackson | B29C 37/0032 |
| 10,913,161 | B2 * | 2/2021 | Jackson | B25J 11/0015 |
| 2024/0269899 | A1 * | 8/2024 | Bächer | B29C 33/3835 |

* cited by examiner

ELASTOMERIC COUPLING METHODS AND DEVICES

BACKGROUND

Animated devices, particularly in entertainment settings, often have artificial, but realistic, skins or other surface coverings (referred to generally here as skin) fitted over the mechanical components of the animated device to impart the appearance of a desired character. Actuators or drivers move portions of the animated device, including portions of the artificial skin, through pre-programmed animations or other live (e.g., puppeteer) motions, to perform part of an entertainment experience. Often the skin is made from an elastomeric material, such as silicone or other rubber.

In conventional methods of attaching the skin to an animated device, a mold core is provided having a similar or same shape as the animated device. The mold core has a plurality of posts adhered to the outer surface that receive actuation points to provide an interface to the actuators of the animated device. The skin is then cast over the actuation points and the mold and allowed to cure. The cured skin and the actuation points are removed from the mold and applied to the animated device. The actuators have corresponding posts to those of the mold such that when the actuation points are applied to the actuators, they can snap over the posts of the actuators.

Such prior methods have a number of shortcomings. For example, the actuation points typically are formed from a high-pressure, molded (e.g., injection molded) polymer with a stiffness significantly greater than that of the polymer material of the skin. The actuation points have a cap with a receptacle that mates with the posts on the actuators of the animated device. The abrupt change in stiffness (e.g., durometer) from the actuation point to the skin material can induce a failure point at the point of attachment. Material incompatibilities between the relatively soft skin and the hard actuation point can cause adhesion problems between the skin and actuation point. Further, the cap of the actuation point can rotate about the post on the actuator as the animated device moves, causing unwanted puckering or dimpling of the skin, wearing out the cap, and causing failures.

Moreover, conventional techniques can introduce an "artificial" appearance into the skin. For example, the stress of attachment and motion of the actuation point is not distributed evenly as in natural (biological) tissues, such as those the animated device is designed to emulate. Such distribution generates artificial-looking motion. Such discrete attachment points cannot accurately represent the smooth, gradual transitions of natural tissues, preventing a natural-looking control of the skin as it moves. Additionally, the relatively hard material of the AP compared to the skin requires expensive, customized high-pressure tooling that results in APs of limited size and shape. New systems and methods of attaching robotic skins are needed.

BRIEF SUMMARY

In one embodiment, a skin for an animated device includes: a membrane formed of a first elastomeric material; a coupling feature coupled to the membrane including: an elongated portion, and a second elastomeric material.

Optionally, in some embodiments, the first elastomeric material and the second elastomeric material are a same material.

Optionally, in some embodiments, the first elastomeric material and the second elastomeric material are a same class of material and the first elastomeric material has a first property different from a first property of the second elastomeric material.

Optionally, in some embodiments, the first property is a durometer.

Optionally, in some embodiments, the durometer of the second elastomeric material is greater than the durometer of the first elastomeric material.

Optionally, in some embodiments, the elongated portion includes a protrusion extending from a surface of the membrane, the protrusion including a neck portion and a head portion.

Optionally, in some embodiments, the head portion includes a lobe configured to couple to a complementary feature of a shell of the animated device.

Optionally, in some embodiments, the coupling feature is configured to enable the skin to move with respect to a shell of the animated device when the skin is coupled to the shell. Optionally, in some embodiments, movement includes a rolling motion.

Optionally, in some embodiments, the elongated portion includes an elongate channel formed in the membrane configured to receive a complementary elongated portion of a shell of the animated device.

Optionally, in some embodiments, at least one of the first elastomeric material or the second elastomeric material includes a magnetic property.

In one embodiment, an animated device includes: a skin including: a membrane formed of a first elastomeric material; a coupling feature coupled to the membrane including: an elongated portion, and a second elastomeric material; a shell including: a complementary elongated portion configured to couple to the elongated portion.

Optionally, in some embodiments, the first elastomeric material and the second elastomeric material are a same class of material and the first elastomeric material has a first property different from a first property of the second elastomeric material.

Optionally, in some embodiments, the elongated portion includes a protrusion extending from a surface of the membrane; the complementary elongated portion includes a receptacle formed in the shell; and the protrusion is removably couplable to the receptacle.

Optionally, in some embodiments, the elongated portion includes an elongate channel formed in the membrane; the complementary elongated portion includes a protrusion formed disposed on, or integrally formed with, the shell; and the protrusion is removably couplable to the receptacle.

Optionally, in some embodiments, the animated device includes an actuator coupled to the shell and removably couplable to the skin.

Optionally, in some embodiments, the actuator includes the complementary elongated portion.

Optionally, in some embodiments, the elongated portion further includes a magnetic property and the complementary elongated portion includes a magnetic element configured to attract the elongated portion through a magnetic force.

DETAILED DESCRIPTION

Figure 1A:
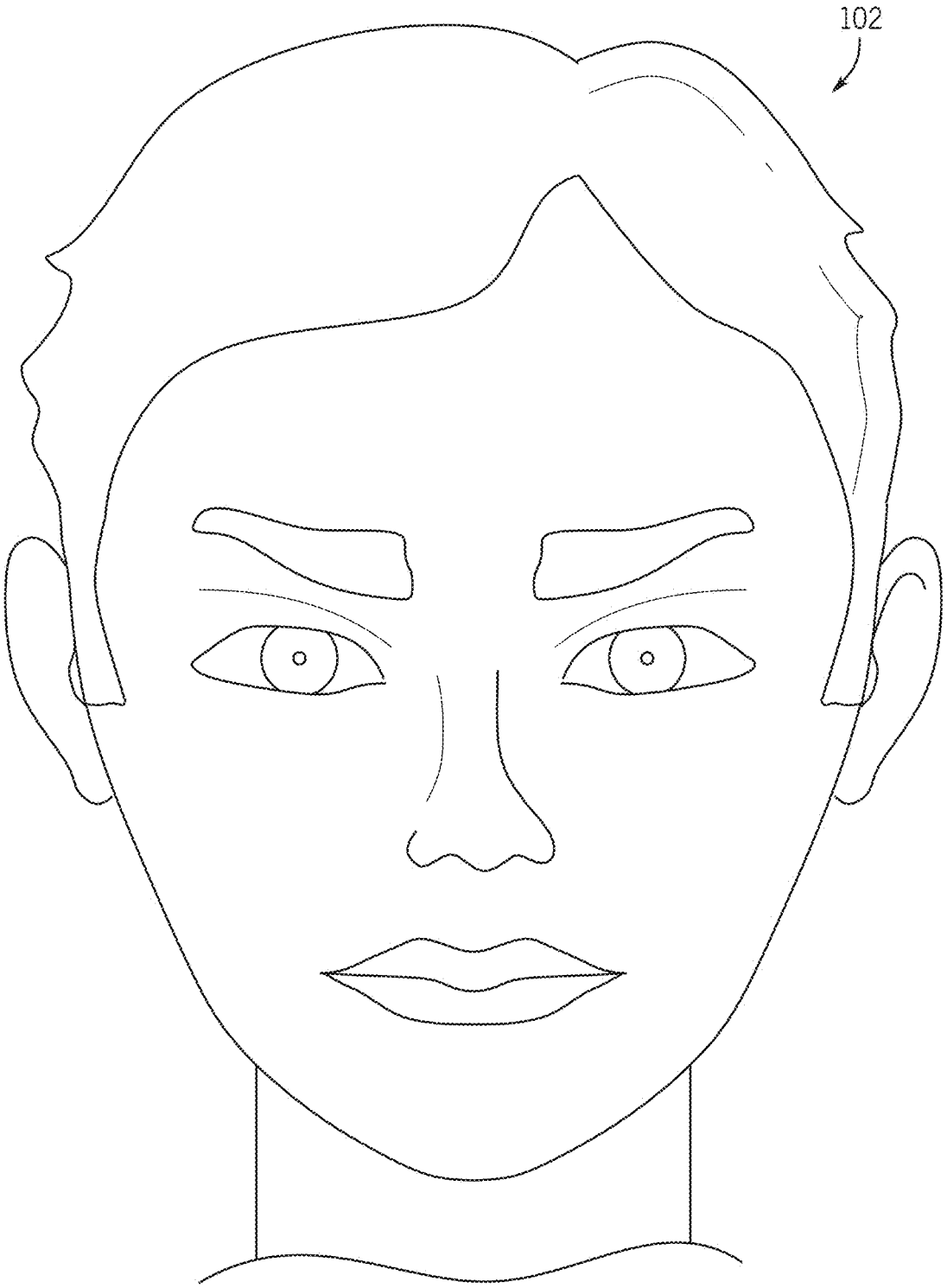
FIG. 1A is a frontal perspective view of a portion of an animated device in s first configuration.

The coupling features, systems, and related methods herein include providing a skin or other aesthetic covering or other surface and a shell (or other supporting substrate) for an animated device. As used herein, an animated device is meant to encompass any device that includes a substrate, one or more actuators, and can receive a skin. The type of animated device may be varied, e.g., a robot, a puppet, a costume, an animatronic device, or the like are all examples of animated devices. The skin generally includes a membrane with one or more coupling features to secure it to the shell. The skin generally fits over at least a portion, if not the entirety of the shell to conceal the shell and define a realistic appearance for the animated device. Often, the skin is made from a more flexible or softer material than the shell. The shell supports and defines a shape of the skin and is configured to actuate various portions, e.g., appendages, to introduce movement to the animated device. The shell includes or is coupled to actuators configured to impart motion to the animated device, which can move the shell, and along with it, portions of the skin.

Coupling features are cast or molded into the skin or shell typically using the same material or a material from the same class but with different properties, as the skin or shell (e.g., a base material). As used herein, a material class is any group of materials with similar chemical structures within a threshold. For example, a class of materials may include materials having the same type of monomer, but may be processed differently or have different functional or cross-linking groups, side chain lengths, main chain lengths, curing methods, catalysts, curing or vulcanizing agents, etc. to give members of the class different properties (e.g., color, durometer, elasticity, hardness, etc.) with respect to one another. A class of materials with a similar chemical structure may be formed of the same repeating chemical group including atoms of the same elements bonded with the same types of chemical bonds (e.g., covalent, ionic, metallic, double, etc.). In another example, a class of materials may use the same catalyst or have the same base parent chemical makeup. For example, a class of polyethylene materials may all have the same repeating ethylene ($H_2H_4$) monomer chemical group. In another example, a class of silicones may all have the same repeating siloxane (e.g., $H[OSiH_2]_nOH$ or $[OSiH_2]_n$) monomer chemical group. For example, a class of skin materials may include a silicone material, or two or more silicone materials having different properties such as durometer, elasticity, density, color, etc.

In some embodiments, the coupling features may be made from a same class of material as the base material, but with a different durometer. That is, the coupling feature may be harder or softer, or more or less dense than the base material, but may have similar properties. For example, the coupling features and the skin may be made from a same class of material (e.g., are both types of silicone), but with one or more different properties (typically hardness). The coupling features are configured to enable freeform and organic connections between the skin and the shell (or actuators), allowing more freedom for creative movement and more realistic skin movement. Further, the coupling features can be distributed across all topographies and areas of the skin, to distribute loads, increasing durability of the skin.

In one example, the coupling feature forms an integral protrusion from the shell. For example, the coupling feature may be cast or molded into the shell using a material having the same class as the class of the base material of the shell. The skin includes a complementary receptacle adapted to receive the protrusion. The protrusion may include features that lock the skin onto the shell, such as to prevent unwanted decoupling or relative movement and may be elongated, such as to impart motion (and coupling) to a large area.

In another example, the coupling feature is in the form of a flexible, substantially linear, or linear protrusion. For example, the protrusion may be cast or molded into the skin using a similar material as the base material of the skin. The shell includes a complementary receptacle adapted to receive the protrusion which may lock the shell onto the skin. The elongated length helps to increase the coupling force along a length and distribute loads.

Any coupling features disclosed may constrain relative motion between the skin and the shell to zero, one, two, three, or more degrees of freedom. For example, a flexible, linear coupling may allow some relative movement between the shell and the skin (e.g., may allow the skin to roll as the actuators move the shell). In another example, a coupling feature may lock the skin onto the shell to prevent or reduce unwanted movement.

In some embodiments, a coupling feature of either the skin or the shell may be conformally or correspondingly shaped, such as to mimic a shape of a biological feature. For example, a coupling feature may be shaped like a muscle, tendon, ligament, bone or other biological structure.

Figure 1B:
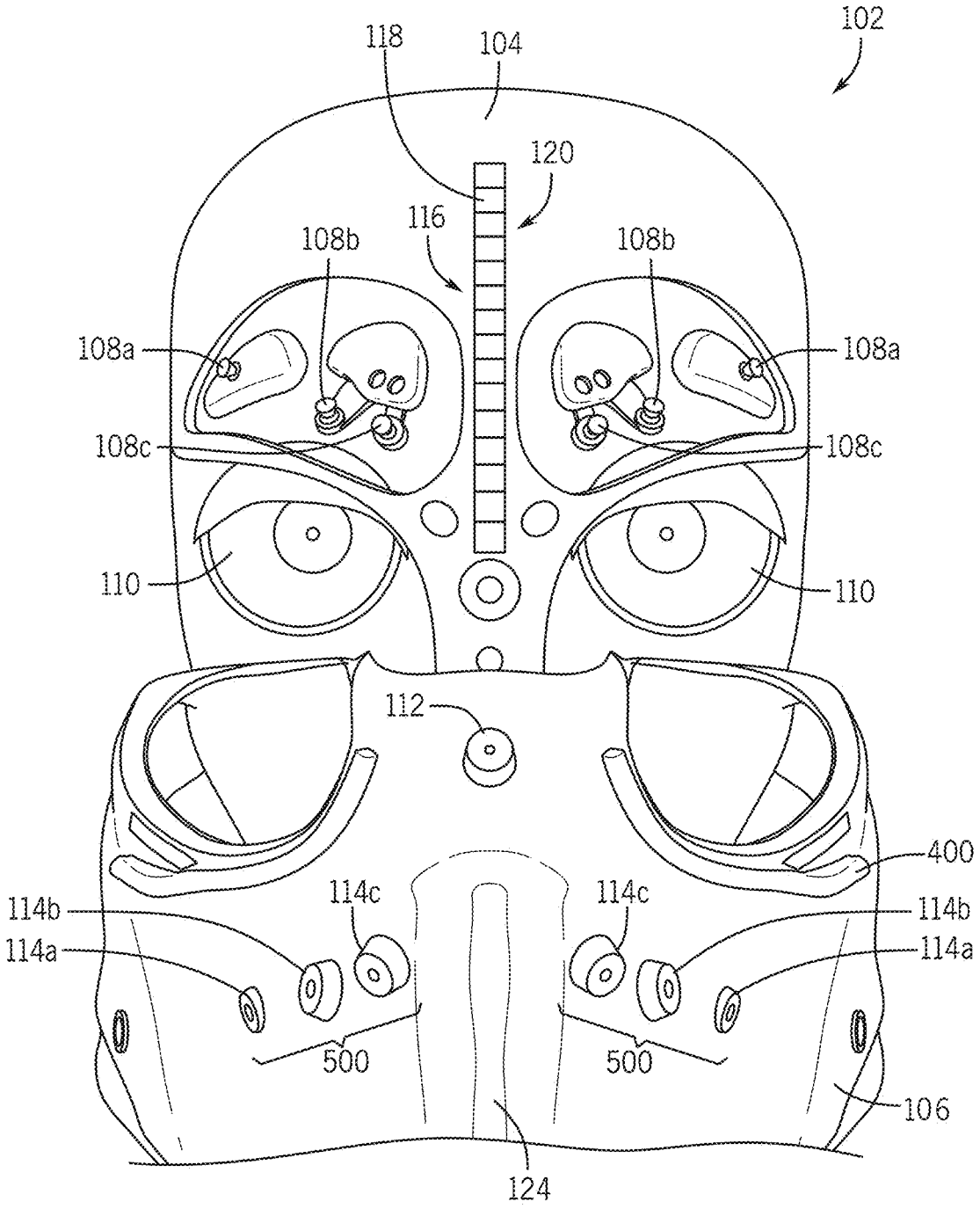
FIG. 1B is a frontal perspective view of a portion of an animated device in a second configuration.

FIG. 1A and FIG. 1B are views of an animated device 102. In FIG. 1A, the animated device 102 is shown with the skin 106 installed. FIG. 1B shows a view of the animated device 102 with the skin partly peeled back to show the underlying structure and components of the animated device 102. In the example shown, the animated device 102 includes a shell 104, a skin 106.

The shell 104 serves as a rigid or semi-rigid structure to provide a base or support for the other components of the animated device 102. The shell 104 often defines the shape of the skin, e.g., as a volumetric shape. In the example shown and described with respect to FIG. 1C, the shell 104 is configured to represent an animal character and the portion illustrated is shaped to define the head of the character. Other shell forms may be used as desired to support components of the animated device 102 to perform the desired animation, e.g., appendages, torso, and other shapes as desired based on the animated device 102. It should be noted that the shell 104 also may define an interior volume, e.g., a cavity, that can be used to house various components, such as controllers for actuators or the like, as well as define the shape of the animated device 102. Further, while the shell 104 is discussed as single structure, it should be understood that in many examples, the shell 104 may be formed of multiple components coupled together, especially in instances where the device includes animated portions and appendages or other movable elements may be separate shell portions that are movably coupled together.

The skin 106 is configured to be positioned over at least a portion of the shell 104 and conceal portions thereof. The skin 106 is typically formed from one or more types of flexible materials, such as elastomeric or rubber materials. In many embodiments, the skin materials mimic the appearance and properties of biological skin or other surfaces, depending on the creature or object being replicated by the animated device 102. In some embodiments, the skin may be formed of one or more of silicone, natural or artificial rubber, polymer (e.g., polyurethane or latex) foam, thermoplastic or thermoset elastomers, polyvinyl chloride, etc. Any of the skin materials may have different hardness (typically measured as durometer). In many examples, skin materials of the same class may have different properties such as durometer. Several actuators such as an actuator 108*a*, an actuator 108*b*, an actuator 108*c* are coupled to the shell and removably coupled to the skin. In other examples, more or fewer actuators may be used. The actuators cause the skin or other portions of the animated device 102 to move to perform an animation. For example, the animated device 102 includes eyes 110 that may be moveable by one or more of the actuators 108*a-c*. Actuators may be pneumatic, hydraulic, electric, piezoelectric, electroactive polymer, or shape memory devices, etc. As can be appreciated the shape, positioning, and movement of the movable portions may be varied based on the character features, e.g., if the character is meant to represent a human it may include movable legs and arms and if the character is meant to represent a bird it may include movable wings and a beak.

The shell 104 may include one or more coupling features adapted to couple (including removably couple) the skin 106 to the shell 104. In many cases, the skin 106 is removably attachable to the shell 104, such as to facilitate replacement of the skin 106 as desired, for example to replace a worn or damaged skin, change skin properties, or even change the character represented by the animated device 102. A coupling feature enables the skin 106 (or other versions of a skin) to be repeatedly and reliably coupled to the shell 104 in many cases.

Figure 1C:
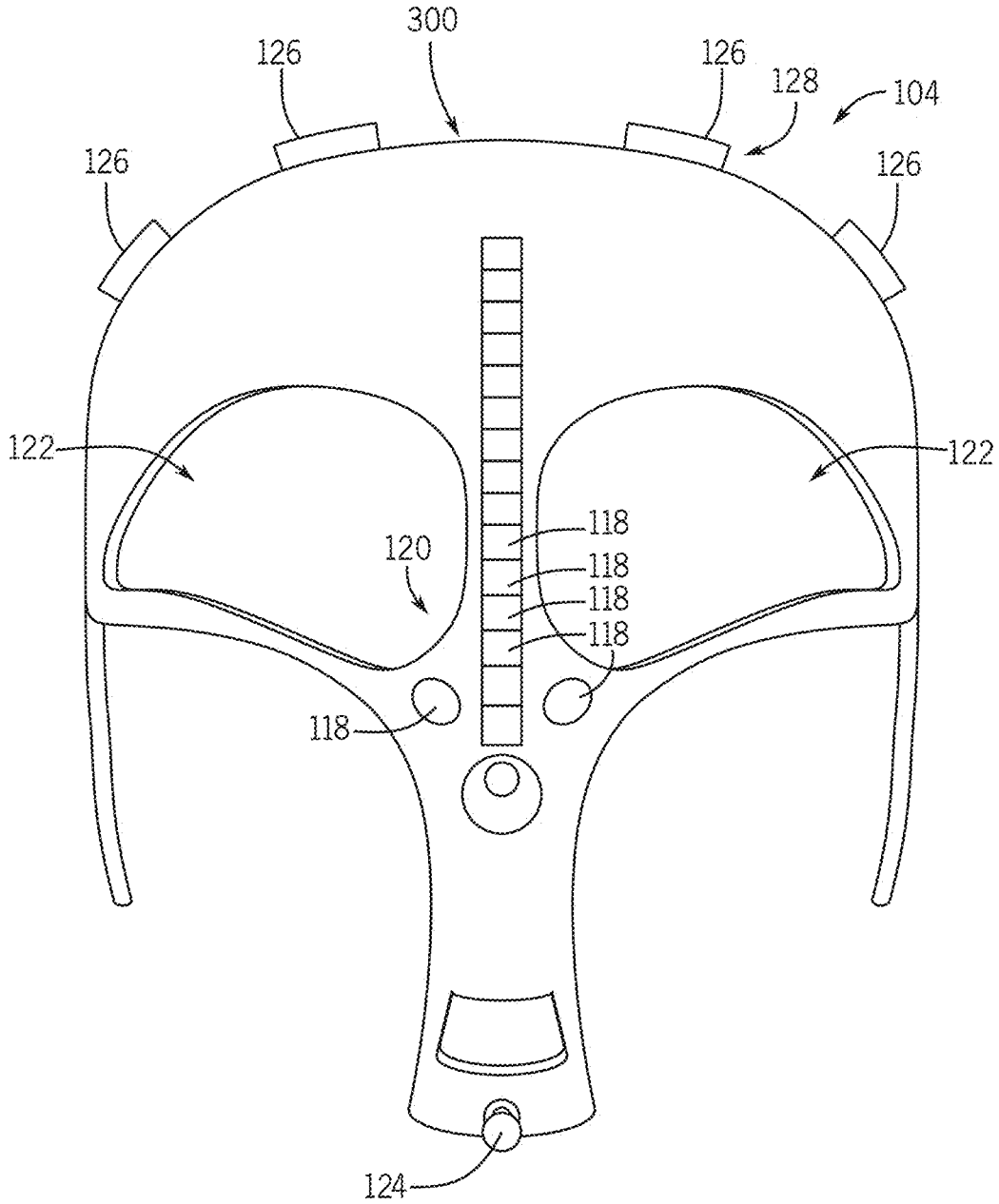
FIG. 1C is a frontal perspective view of a shell of the animated device of FIG. 1B.

Coupling features may be in many forms, depending on the desired coupling strength, movement relative to the shell, as well as degrees of movement expected for the shell portion onto which the skin will be attached. For example as shown in FIG. 1B and FIG. 1C, a coupling feature may be a point coupling feature 112; channel coupling feature 300; a post coupling feature 124; a flexible linear coupling feature 400; a conformal coupling feature 500 including two or more sub-coupling features such as a sub-coupling feature 114*a*, a sub-coupling feature 114*b*, a sub-coupling feature 114*c*; and/or a magnetic coupling feature 120 including a magnetic array 116 with one or more magnetic elements 118. Generally, a channel coupling feature 300 includes an elevated portion or portions that protrude from the shell 104 and are couplable to the skin 106. In contrast, generally, a flexible linear coupling feature 400 includes an elevated portion or portions that protrude from the skin 106 and are couplable to the shell 104. Additionally, or alternately, a channel protrusion 300, often being formed of the material of the shell is typically more rigid than a flexible, linear coupling feature made from the soft (relative to the shell 104) material of the skin 106. Any of the elevated portions of the channel or flexible linear coupling features may be elongated. A post coupling feature typically includes a single attachment point that extends from the surface (inner or outer) of the skin 106 to provide a single connection point. Conformal coupling features 500 typically mimic some sort of biological feature or blend with the overall shape of the shell or skin. A conformal coupling feature 500 may be formed of any other type of coupling feature, e.g., channel coupling feature 300; a post coupling feature 124; a flexible linear coupling feature 400

As shown for example in FIG. 1C, a channel coupling feature 300 may be formed from one or more elevated portions 126 of the shell 104 spaced apart from one another by one or more recessed portions 128. The shell 104 may include an eye socket 122 adapted to receive an eye 110 of the animated device 102.

Figure 2:
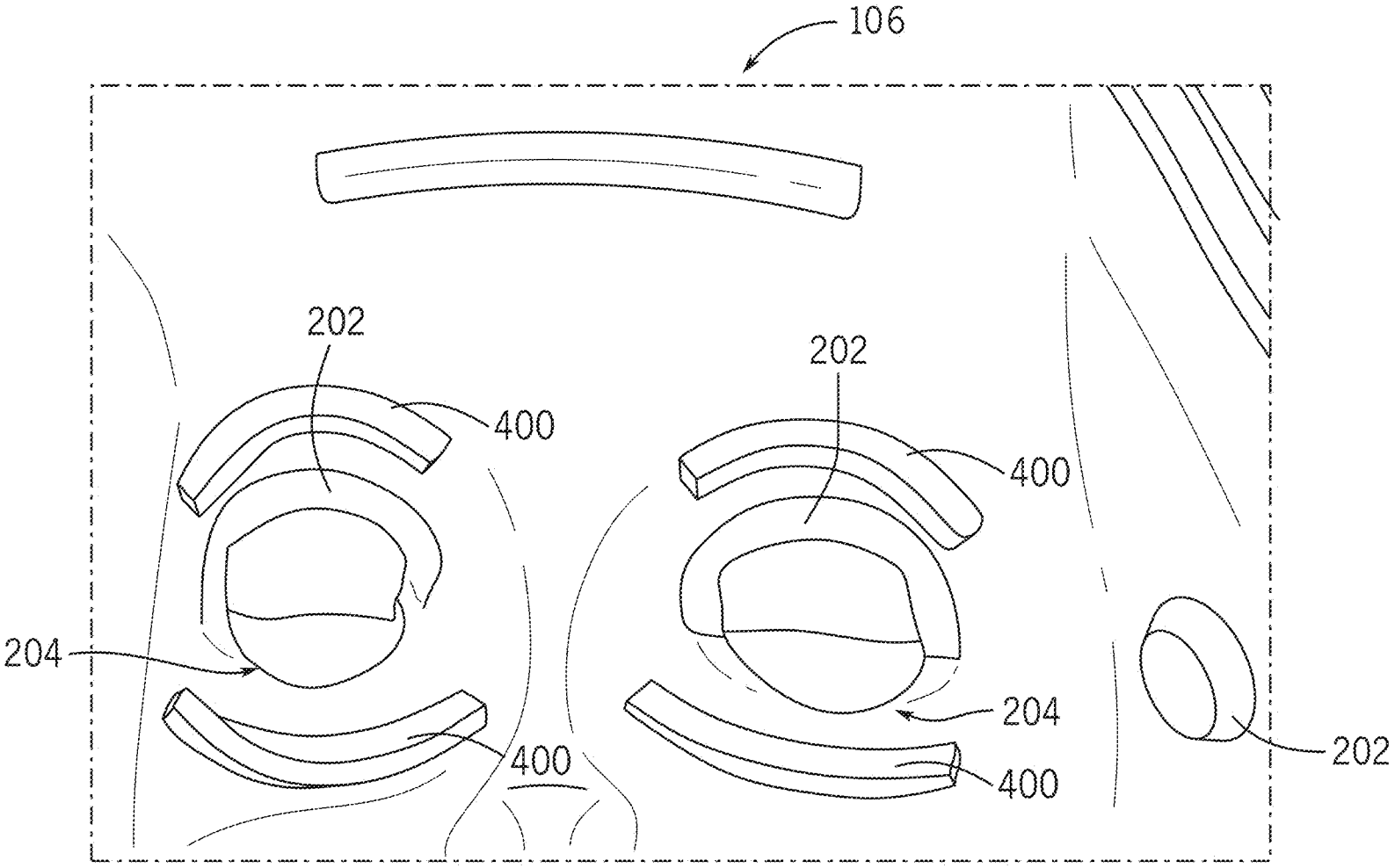
FIG. 2 is a perspective view of a skin suitable for use with the animated device of FIG. 1B.

Turning to FIG. 2, an example of a skin 106 is shown. Specifically, FIG. 2 shows an inner view of a skin 106. The example skin 106 is a skin for the face of an animated device 102. The skin 106 includes apertures 204 suitable for eyes 110 to be visible through. The skin 106 includes a plurality of coupling features defined or coupled thereto, e.g., the features may extend from an interior or rear surface of the skin 106. For example, the skin 106 includes a flexible linear coupling feature 400 above and below each of the eye apertures 204. The flexible linear coupling feature 400 is typically molded into the skin 106 (e.g., as with the method 700 described with respect to FIG. 7). In some embodiments, the flexible linear coupling feature 400 may be adhered to the skin (e.g., with an adhesive). The skin 106 includes a flexible linear coupling feature 400 in the brow region and a point coupling feature 202 near a temple region. The flexible linear coupling feature 400 and/or point coupling feature 202 may have a magnetic property. For example, a magnetic compound may be added to the polymer that forms the coupling feature such that the cured coupling feature is attracted by magnetic forces, such as generated by the magnetic coupling feature 120 of the shell 104. For example, the flexible linear coupling feature 400 and/or point coupling feature 202 may have ferromagnetic powder added to the elastomer and incorporated into the elastomer as it cures. The magnetic elements 118 of the magnetic coupling feature 120 may be permanent magnets or electromagnets to which the ferromagnetic powder is attracted. Thus, the interaction between the flexible linear coupling feature 400 and/or point coupling feature 202 may help retain or locate the skin 106 on the shell 104.

Figure 3A:
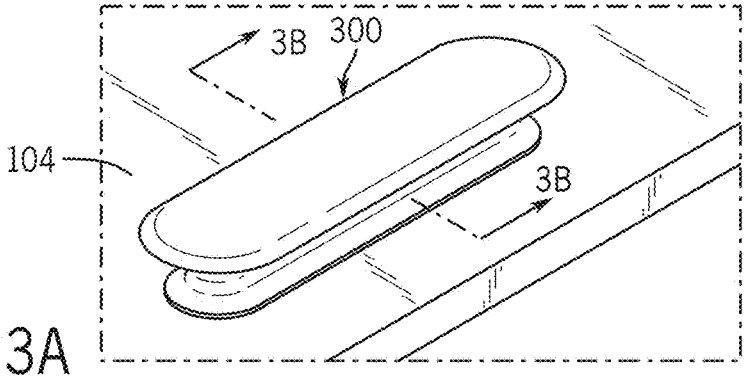
FIG. 3A is a perspective view of a coupling feature of the animated device of FIG. 1B.
Figure 3B:
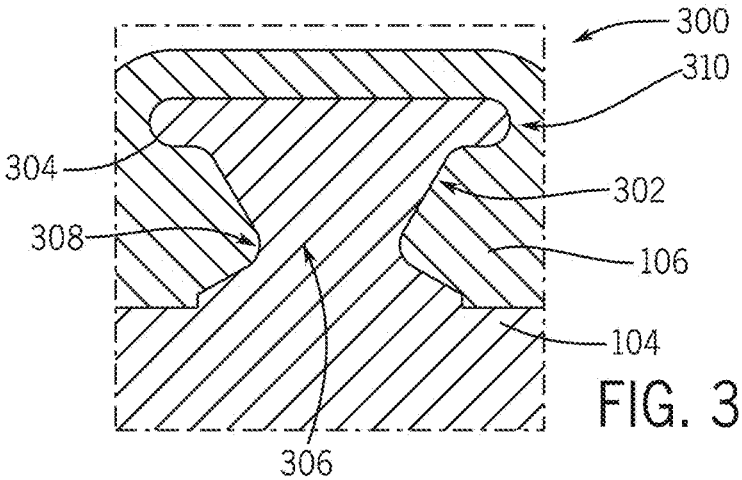
FIG. 3B is a section view of the coupling feature of FIG. 3A taken along line 3B-3B of FIG. 3A.

Turning to FIG. 3A and FIG. 3B, an embodiment of a channel coupling feature 300 is shown. The channel coupling feature 300 is formed by a protrusion 306 that extends or rises from the surface of the shell 104 (e.g., as shown with respect to FIG. 1C). In some embodiments, a channel coupling feature may include a tongue in groove or "dovetail" type connection. As shown for example in FIG. 3B, the channel coupling feature 300 may have a shape that fits with a correspondingly shaped channel 302 formed in the skin 106. The channel coupling feature 300 and the channel 302 may be configured to "snap" or click" together, or to locate the skin 106 with respect to the shell 104. In some embodiments, a channel coupling feature 300 can spread motion or other forces imparted to the skin 106 by the actuators of the animated device 102 over a wider area than previous connection methods. In some embodiments, the channel coupling feature 300 may branch, fork, or bend. In some embodiments, the cross section of the protrusion 306 of the channel coupling feature 300 may vary along a length of the channel coupling feature 300. For example, the cross section may change shape, increase in size, decrease in size, etc.

A benefit of the coupling of the skin 106 and the shell 104 may be that the skin 106 is easy to locate on the shell 104 to achieve quick changes of skin with repeatable animation results. Prior methods require skilled technicians to accurately locate a new skin 106 on a shell 104 to avoid drooping or sagging features that can ruin an animation effect. Here, the coupling features enable easy and repeatable coupling of a skin 106 and shell 104 without specialize skills or tools.

In some embodiments, the channel coupling feature 300 may be elongated, as well as be continuous or discontinuous (e.g., as shown for example in FIG. 1C), e.g., may include breaks or spaces between elevated portions. An advantage of a continuous coupling feature may be more secure coupling of the skin and shell compared to a discontinuous coupling feature. An advantage of a discontinuous coupling feature may be easier removal of portions of the skin from the shell, e.g., for maintenance, assembly, or disassembly of the animated device. The protrusion 306 may have a varying cross-section (e.g., may be tapered or may widen along the length) which can be configured to replicate the shape of natural tissues. In some embodiments, the protrusion 306 may include multiple layers of materials having different properties (e.g., stiffness) such as to simulate natural tissues of a biological element.

The example channel coupling feature 300 shown in FIG. 3A includes a head portion 310 coupled to, or formed with, the main body of the shell 104 via a relatively narrower neck portion 308. The head portion 310 includes a lobe 304. The example channel coupling feature 300 shown is substantially symmetrical but may be asymmetrical in other embodiments. Where the channel coupling feature 300 is symmetrical, one side of the channel coupling feature 300 may be described, with the understanding that the other side is a mirror image of the first side, further description of which is omitted for brevity. In the example channel coupling feature 300 shown, the head portion 310 includes a lobe 304 that protrudes laterally from the head portion 310. The lobe 304 may be angular or may be rounded (e.g., as shown). The skin 106 may include corresponding neck, head, and lobe or other portions that receive the corresponding portions of the channel coupling feature 300. Thus, the skin 106 may be easily coupled (including removably coupled) to the shell 104 as desired.

In some embodiments, the channel coupling feature 300 can be used to control rotation or other movement of the skin 106 with respect to the shell 104. For example, the lobe 304 may prevent or limit relative rotation of the skin 106 with respect to the shell 104. In other embodiments, the head portion 310 may include rounded or other features that enable some rotation of the skin 106 with respect to the shell 104.

The channel coupling feature 300 may be made of the same material as the shell 104 or a different material. In some embodiments, the shell 104 is made of the same class of material as the channel coupling feature 300 but with one or more different properties. For example, the shell 104 may be made of a relatively hard (e.g., high durometer) polymer (such as polyethylene) while the channel coupling feature 300 may be made of a softer or more compliant polyethylene material. In some embodiments, the channel coupling feature 300 may include layers or portions of different materials to achieve more accurate or lifelike motions of the animated device 102.

Figure 4A:
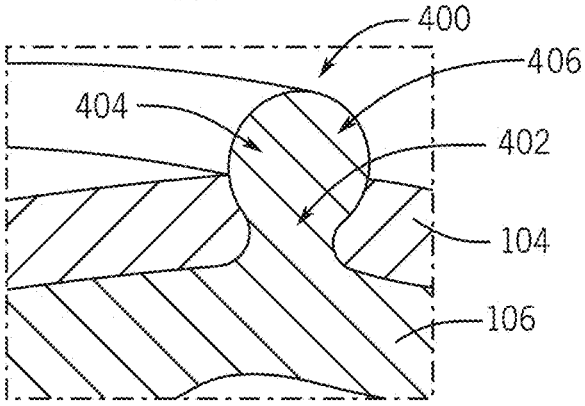
FIG. 4A is a perspective view of a coupling feature of the animated device of FIG. 1B.
Figure 4B:
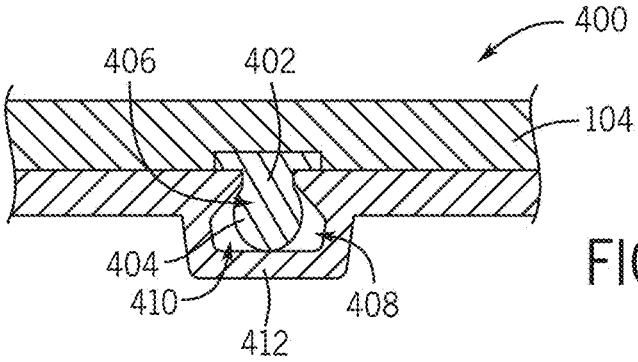
FIG. 4B is a section view of the attachment of FIG. 4A taken along line 4B-4B of FIG. 4A.
Figure 5A:
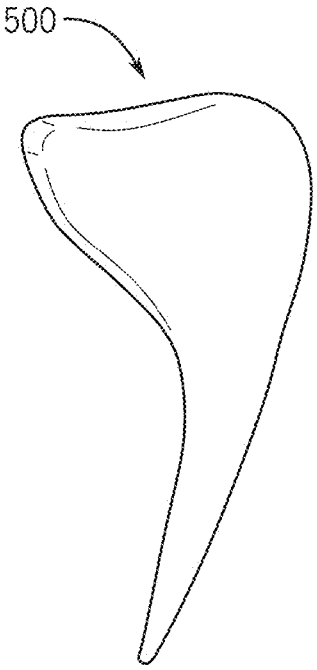
FIG. 5A is a frontal perspective view of a coupling feature of the animated device of FIG. 1B.
Figure 5B:
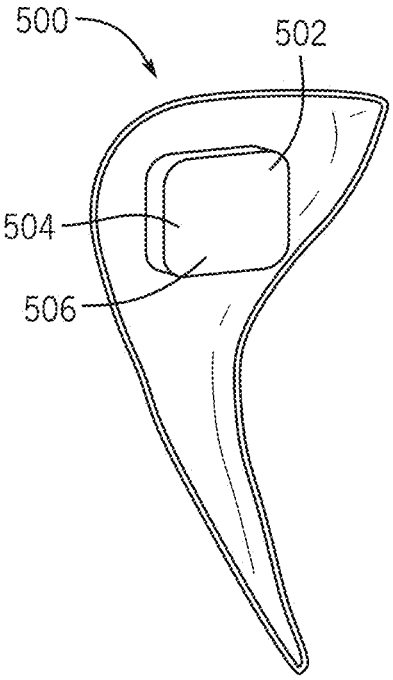
FIG. 5B is a rear perspective view of the coupling feature of FIG. 5A.
Figure 6A:
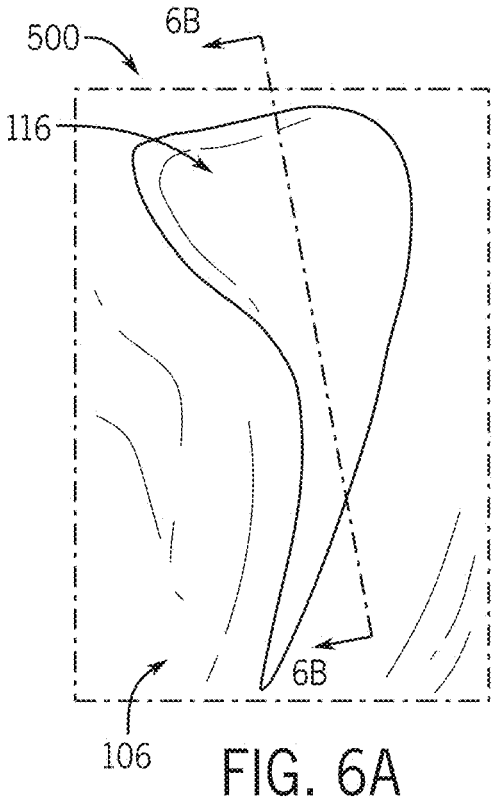
FIG. 6A is a perspective view of the coupling feature of FIG. 5A shown in an installed configuration on the animated device of FIG. 1B.
Figure 6B:
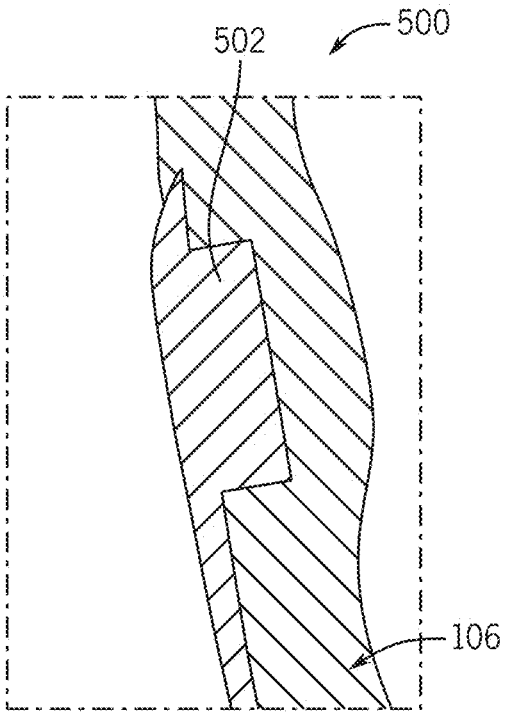
FIG. 6B is a section view of the coupling feature of FIG. 5A taken along line 6B-6B of FIG. 6A.

Turning to FIG. 4A and FIG. 4B, an embodiment of a flexible linear coupling feature 400 is shown. The elongated length of the flexible linear coupling feature 400 helps to increase the coupling force along a length and distribute loads. The flexible linear coupling feature 400 may provide a flexible or semi-flexible connection between the shell 104 and the skin 106. In some embodiments, the flexible linear coupling feature 400 may enable the skin 106 to roll with respect to the shell 104. The flexible linear coupling feature 400 is in the form of a flexible, substantially linear, or linear protrusion. The example flexible linear coupling feature 400 rises or extends from the surface of the skin 106. For example, the flexible linear coupling feature 400 may include a protrusion 406 with a neck portion 402 and a relatively wider head portion 404. The shell 104 includes a complementary receptacle 410 adapted to receive the protrusion 406 which may lock the shell 104 onto the skin 106. In some embodiments, a flexible linear coupling feature 400 may be of a smaller or lower profile than other coupling features disclosed herein.

In some embodiments, the receptacle 410 has a complementary shape to the protrusion 406 such that the protrusion 406 may be received in the receptacle 410. For example, the protrusion 406 may "snap" or "click" into the receptacle 410. In some embodiments, the receptacle 410 includes a clearance portion 408 with a dimension greater than a corresponding portion of the protrusion 406 (shown for example in FIG. 4B). In some embodiments, the receptacle 410 includes a cap 412, e.g., as shown in FIG. 4B. In some embodiments, the cap 412 is optional and may not be included, e.g., as shown in FIG. 4A. The clearance portion 408 may enable the head portion 404 and/or neck portion 402 to rotate or move within the receptacle 410. This movement may allow the animated device 102 to achieve a more natural animation compared to prior techniques.

The flexible linear coupling feature 400 may be made of the same material as the skin 106 or a different material. In some embodiments, the skin 106 is made of the same class of material as the flexible linear coupling feature 400 but with one or more different properties. For example, the skin 106 may be made of a relatively soft (e.g., low durometer) polymer (such as silicone) while the flexible linear coupling feature 400 may be made of a stiffer or harder silicone material. In some embodiments, the flexible linear coupling feature 400 may include layers or portions of different materials to achieve more accurate or lifelike motions of the animated device 102.

Turning to FIG. 5A-FIG. 5D, an example of a conformal coupling feature 500 is shown and described. A conformal coupling feature 500 may be shaped like an anatomical feature or biological structure. A coupling feature of either the skin or the shell may be conformally or correspondingly shaped, such as to mimic a shape of a biological feature. For example, the conformal coupling feature 500 shown may have a shape and/or size corresponding to a portion of a face of an animated device 102.

The conformal coupling feature 500 may include a locator 502 that helps position the conformal coupling feature 500 with respect to the skin 106 and/or the shell 104. The locator 502 may include a protrusion 504 that rises or extends from an inner surface of the conformal coupling feature 500. In some embodiments, the protrusion 504 may be a magnetic coupling feature 506 configured to be attracted to a corresponding magnetic feature on the shell 104 or the skin 106.

The conformal coupling feature 500 may be made of the same material as the skin 106 or a different material. In some embodiments, the skin 106 is made of the same class of material as the conformal coupling feature 500 but with one or more different properties. For example, the skin 106 may be made of a relatively soft (e.g., low durometer) polymer (such as silicone) while the conformal coupling feature 500 may be made of a stiffer or harder silicone material. In some embodiments, the conformal coupling feature 500 may include layers or portions of different materials to achieve more accurate or lifelike motions of the animated device 102.

Figure 7:
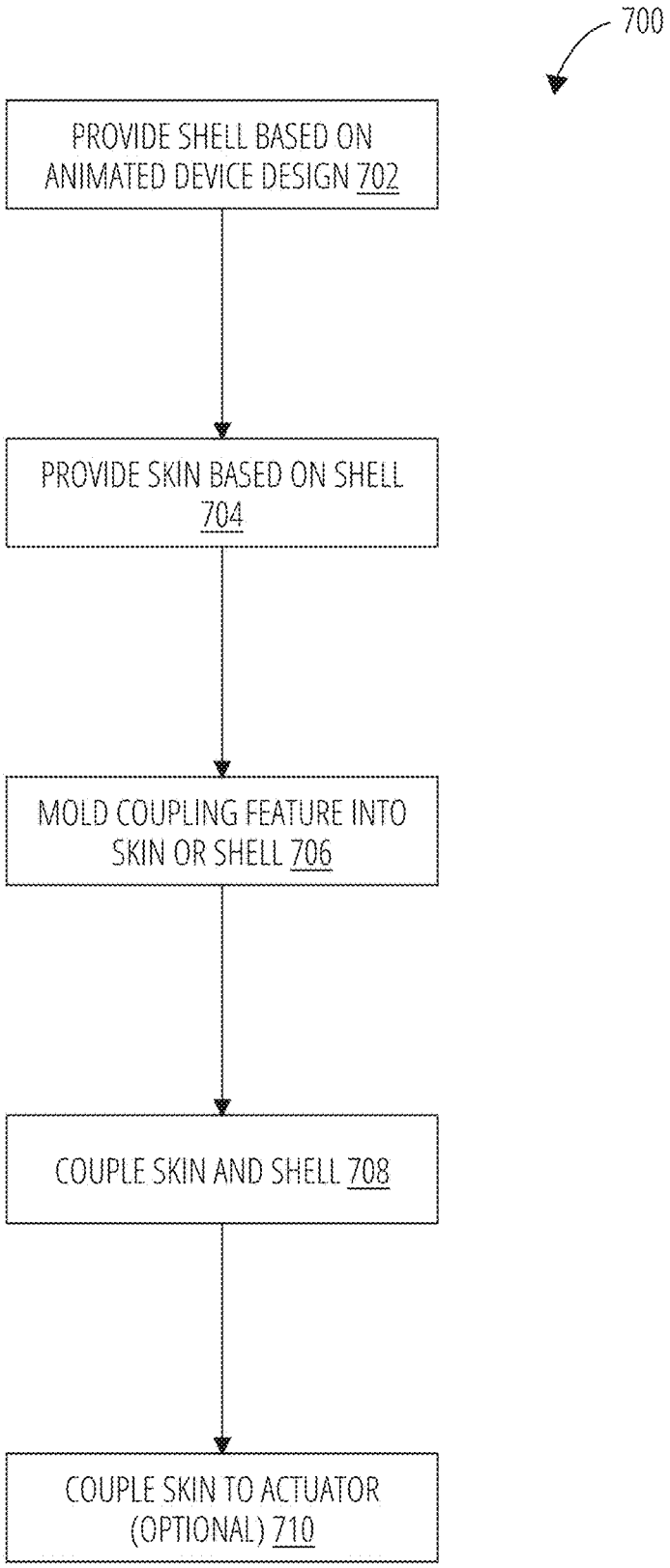
FIG. 7 is a flow chart of a method of providing an artificial skin for an animated device.

FIG. 7 illustrates an example method 700 for providing a skin for an animated device 102. Although the example method 700 depicts a particular sequence of operations, the sequence may be altered without departing from the scope of the present disclosure. For example, some of the operations depicted may be performed in parallel or in a different sequence that does not materially affect the function of the method 700. In other examples, different components of an example device or system that implements the method 700 may perform functions at substantially the same time or in a specific sequence.

According to some examples, the method 700 includes providing a shell 104 based on an animated device design at operation 702. For example, a user may generate a design for a character or model for the animated device 102. The model may include a computer-generated solid model of the character. A shell is created based on the model. For example, where the character is a human, the shell may be substantially similar to a human skull. Where the character is a fictional or fantasy character, the shell may be shaped to provide a structure to the animated device 102 and to provide support for the actuators that execute the animation of the 102.

According to some examples, the method 700 includes providing a skin based on the shell at operation 704. The skin design may be based on layers of simulated or actual soft tissue that the animated device 102 is meant to emulate. For example, where the animated device 102 is a human character, the skin may include layers of elastomers that emulate the properties, motion, and/or structure of the layers of human soft tissue, such as tendons, ligaments, fat, muscle, skin, and/or hair. The skin may be cast or molded from a skin material such as silicone or another elastomer. For example, a mold may be created representing a "negative" structure of the skin and/or shell. The mold may be filled with a skin material and the material allowed to harden or cure. The skin may be removed from the mold subsequent to the curing process. In some embodiments, the skin may be removed from the mold before the curing process is complete (e.g., the elastomer is still slightly soft and under-cured).

According to some examples, the method 700 includes coupling one or more coupling features into the skin or shell at operation 706. The coupling features may be any coupling feature disclosed herein. In many examples, the coupling features are molded or cast into the skin 106 or shell 104. The coupling features may be made of the same or similar materials or same class of materials as the skin. In some embodiments, the coupling features may be cast or molded into the skin while the skin is under-cured. A benefit of this embodiment of the operation 760 may be that, the coupling feature chemically integrates with the base material of the skin. For example, when a fresh, uncured elastomeric material of a coupling feature is cast or molded into the under-cured base material of the skin, and the materials of the skin and the coupling feature are of the same class of material, the coupling feature material may chemically bond with the under-cured skin material and vice-versa as both materials cure. Thus, a strong, bond between the skin and coupling feature may be formed. Furthermore, the properties of the mixing region where the skin and coupling feature materials intermingle may have a gradient of properties from the skin to the coupling feature (e.g., durometer) thereby reducing stress and improving the lifelike appearance and reliability of the resulting animated device. The method 700 improves over prior methods of providing skins to animated features. For example, by first casting the skin as in the operation 704, and then casting or molding the coupling features into the skin, better adhesion between the skin and the coupling features may be achieved. With better adhesion, the coupling features and skin may provide for more lifelike or accurate motion for the animated device 102, increased reliability due to the reduction or elimination of stress risers, and/or improvement in the case of replacing a skin 106 on an animated device 102.

According to some examples, the method 700 includes coupling the skin to one or more actuators at operation 710. In some examples, the operation 710 is optional. An actuator may include any coupling feature disclosed herein. For example, an actuator may include a channel coupling feature 300 couplable to a channel 302 formed in the skin 106. In another example, the actuator may include a receptacle 410 configured to receive a flexible linear coupling feature 400. In another example, a post on the shell 104 and/or an actuator may be received in a receptacle of any of the coupling features disclosed herein.

According to some examples, the method 700 includes coupling the skin to one or more actuators at operation 710. In some examples, the operation 710 is optional. An actuator may include any coupling feature disclosed herein. For example, an actuator may include a channel coupling feature 300 coupleable to a channel 302 formed in the skin 106. In another example, the actuator may include a receptacle 410 configured to receive a flexible linear coupling feature 400. In another example, a post on the shell 104 and/or an actuator may be received in a receptacle of any of the coupling features disclosed herein.

The description of certain embodiments included herein is merely exemplary in nature and is in no way intended to limit the scope of the disclosure or its applications or uses. In the included detailed description of embodiments of the present systems and methods, reference is made to the accompanying drawings which form a part hereof, and which are shown by way of illustration specific to embodiments in which the described systems and methods may be practiced. These embodiments are described in sufficient detail to enable those skilled in the art to practice presently disclosed systems and methods, and it is to be understood that other embodiments may be utilized, and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The included detailed description is therefore not to be taken in a limiting sense, and the scope of the disclosure is defined only by the appended claims.

From the foregoing it will be appreciated that, although specific embodiments of the invention have been described herein for purposes of illustration, various modifications may be made without deviating from the spirit and scope of the invention.

The particulars shown herein are by way of example and for purposes of illustrative discussion of the preferred embodiments of the present disclosure and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

As used herein and unless otherwise indicated, the terms "a" and "an" are taken to mean "one", "at least one" or "one or more". Unless otherwise required by context, singular terms used herein shall include pluralities and plural terms shall include the singular.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

All relative, directional, and ordinal references (including top, bottom, side, front, rear, first, second, third, and so forth) are given by way of example to aid the reader's understanding of the examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Of course, it is to be appreciated that any one of the examples, embodiments or processes described herein may be combined with one or more other examples, embodiments and/or processes or be separated and/or performed amongst separate devices or device portions in accordance with the present systems, devices and methods.

Finally, the above discussion is intended to be merely illustrative of the present system and should not be construed as limiting the appended claims to any particular embodiment or group of embodiments. Thus, while the present system has been described in particular detail with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

What is claimed is:

1. A skin for an animated device comprising:
a membrane formed of a first elastomeric material;
a coupling feature coupled to the membrane comprising:
an elongated portion formed of a second elastomeric material, the elongated portion including one of a flexible linear protrusion extending from an inner surface of the membrane or an elongated channel formed in the membrane, wherein:
the coupling feature is configured to removably couple to a complementary elongated receptacle of a shell of the animated device.

2. The skin of claim 1, wherein the first elastomeric material and the second elastomeric material are a same material.

3. The skin of claim 1, wherein the first elastomeric material and the second elastomeric material are a same class of material and the first elastomeric material has a first property different from a first property of the second elastomeric material.

4. The skin of claim 3, wherein the first property is a durometer, and wherein the durometer of the second elastomeric material is greater than the durometer of the first elastomeric material.

5. The skin of claim 1, wherein the elongated portion comprises the flexible linear protrusion, and the flexible linear protrusion includes a neck portion and a head portion.

6. The skin of claim 5, wherein the head portion comprises a lobe configured to couple to a complementary feature of the shell of the animated device.

7. The skin of claim 5, wherein the complementary elongated receptacle includes a clearance portion having a dimension greater than a corresponding dimension of at least one of the head portion or the neck portion of the flexible linear protrusion to permit rotation or movement of the flexible linear protrusion within the complementary elongated receptacle.

8. The skin of claim 7, wherein the complementary elongated receptacle includes a cap configured to retain the head portion of the flexible linear protrusion within the complementary elongated receptacle while permitting rotation or movement within the clearance portion.

9. The skin of claim 1, wherein the coupling feature is configured to enable the skin to move with respect to the shell of the animated device when the skin is coupled to the shell.

10. The skin of claim 9, wherein the skin moves with a rolling motion.

11. The skin of claim 1, wherein at least one of the first elastomeric material or the second elastomeric material includes a magnetic property.

12. The skin of claim 1, wherein the coupling feature is cast or molded into the membrane.

13. An animated device comprising:
a skin comprising:
a membrane formed of a first elastomeric material;
a coupling feature coupled to the membrane comprising:
an elongated portion formed of a second elastomeric material;
a shell comprising:
a complementary elongated portion configured to couple to the elongated portion; wherein:
the elongated portion comprises one of an elongated channel formed in the membrane or a protrusion extending from a surface of the membrane, and
the complementary elongated portion comprises one of a second protrusion disposed on, or integrally formed with, the shell, or a receptacle formed in the shell and having a dovetail cross-section removably couplable to the elongated channel.

14. The animated device of claim 13, wherein the first elastomeric material and the second elastomeric material are a same class of material and the first elastomeric material has a first property different from a first property of the second elastomeric material.

15. The animated device of claim 14, wherein the first property is a durometer, and wherein the durometer of the second elastomeric material is greater than the durometer of the first elastomeric material.

16. The animated device of claim 14, further comprising an actuator coupled to the shell and removably couplable to the skin.

17. The animated device of claim 16, wherein the actuator includes the complementary elongated portion.

18. The animated device of claim 13, wherein the elongated portion further comprises a magnetic property and the complementary elongated portion comprises a magnetic element configured to attract the elongated portion through a magnetic force.

19. The animated device of claim 13, wherein the complementary elongated portion comprises an elongated protrusion on the shell that is continuous along at least a portion of its length and includes at least one branch, fork, or bend.

20. The animated device of claim 13, wherein a cross-section of the complementary elongated portion varies along its length.

* * * * *